US009080126B2

(12) United States Patent
Hartley et al.

(10) Patent No.: US 9,080,126 B2
(45) Date of Patent: Jul. 14, 2015

(54) LUBRICATING OIL COMPOSITION

(71) Applicant: Infineum International Limited, Abingdon (GB)

(72) Inventors: Joseph P. Hartley, Oxford (GB); Jonathan P. Flemming, Oxford (GB)

(73) Assignee: INFINEUM INTERNATIONAL LIMITED (GB)

( * ) Notice: Subject to any disclaimer, the term of this patent is extended or adjusted under 35 U.S.C. 154(b) by 0 days.

(21) Appl. No.: 13/953,798

(22) Filed: Jul. 30, 2013

(65) Prior Publication Data

US 2015/0034034 A1 Feb. 5, 2015

(30) Foreign Application Priority Data

Jul. 31, 2012 (EP) ..... 12178710

(51) Int. Cl.

| | |
|---|---|
| ***F02B 43/00*** | (2006.01) |
| ***C10M 141/10*** | (2006.01) |
| *F02D 19/08* | (2006.01) |
| *F02B 3/06* | (2006.01) |
| *F02M 25/00* | (2006.01) |
| *F02B 43/10* | (2006.01) |
| *F02B 1/04* | (2006.01) |

(52) U.S. Cl.

CPC ..... *C10M 141/10* (2013.01); *C10M 2219/068* (2013.01); *C10M 2223/045* (2013.01); *C10N 2210/02* (2013.01); *C10N 2230/06* (2013.01); *C10N 2230/36* (2013.01); *C10N 2240/10* (2013.01); *C10N 2240/102* (2013.01); *F02B 1/04* (2013.01); *F02B 3/06* (2013.01); *F02B 43/10* (2013.01); *F02D 19/08* (2013.01); *F02M 25/00* (2013.01)

(58) Field of Classification Search

CPC ..... F02B 1/04; F02B 43/10; F02B 3/06; F02M 25/00; F02D 19/08

USPC ..... 123/1 A

See application file for complete search history.

(56) References Cited

U.S. PATENT DOCUMENTS

| | | | | |
|---|---|---|---|---|
| 5,428,089 | A * | 6/1995 | Ishikawa et al. | 252/8.84 |
| 5,576,273 | A * | 11/1996 | Karol et al. | 508/364 |
| 5,629,272 | A * | 5/1997 | Nakazato et al. | 508/185 |
| 5,885,942 | A | 3/1999 | Zhang et al. | |
| 2006/0025313 | A1 | 2/2006 | Boffa | |
| 2011/0297122 | A1* | 12/2011 | Bardasz | 123/299 |

FOREIGN PATENT DOCUMENTS

| | | |
|---|---|---|
| EP | 0588561 A1 | 3/1994 |
| EP | 2248876 A1 | 11/2010 |

OTHER PUBLICATIONS

Scorpion Racing Products; ZDDP Guidelines for Motor Oil Selection, 2009, Scorpion Performance, Technical: Engine Oil Selection, 1-3.*

* cited by examiner

*Primary Examiner* — Lindsay Low
*Assistant Examiner* — Charles Brauch

(57) ABSTRACT

An automotive lubricating oil composition for an internal combustion engine comprises (A) an oil of lubricating viscosity in a major amount; and (B) oil-soluble additive components in respective minor amounts comprising (B1) a zinc dihydrocarbyl dithiophosphate additive; and (B2) an alkylenebis(dihydrocarbyldithiocarbamate) where at least one of the hydrocarbyl groups in an aryl group, the composition having not greater than 1600 ppm by mass of phosphorus, expressed as phosphorus atom.

15 Claims, No Drawings

LUBRICATING OIL COMPOSITION

FIELD OF THE INVENTION

The present invention relates to automotive lubricating oil compositions, more especially to automotive lubricating oil compositions for use in piston engines, especially gasoline (spark-ignited) and diesel (compression-ignited), crankcase lubrication, such compositions being referred to as crankcase lubricants. In particular, although not exclusively, the present invention relates to use of additives with antiwear properties in automotive lubricating oil compositions; and that do not adversely affect the fluoroelastomer seals compatibility of the composition.

BACKGROUND OF THE INVENTION

A crankcase lubricant is an oil used for general lubrication in an internal combustion engine where an oil sump is situated generally below the crankshaft of the engine and to which circulated oil returns. It is well known to include additives in crankcase lubricants for several purposes.

Phosphorus in the form of dihydrocarbyl dithiophosphate metal salts has been used for many years to provide lubricating oil compositions for internal combustion engines with antiwear properties. The metal may be zinc, an alkali or alkaline earth metal, or aluminium, lead, tin, molybdenum, manganese, nickel or copper. Of these, zinc salts of dihydrocarbyl dithiophosphate (ZDDPs) are most commonly used. However, anticipation of stricter controls on the amount of phosphorus in finished crankcase lubricants has led to the need to, at least partially, replace ZDDP in such lubricants.

The art describes phosphorus-free antiwear additives in the form of dithiocarbamates, some of which are commercially-available, such as methylenebis(dibutyldithiocarbamate) which is available under the trade name VANLUBE (Registered Trade Mark) 7723. Vanderbilt International Sarl's information brochure, entitled LUBRICANT ADDITIVES and dated 01/10, describes VANLUBE 7723 as a general purpose, ashless antioxidant which should find application in petroleum lubricants of all types, and to be useful as a component of additive packages. One of its functions is stated to be antiwear. A problem with use of such ashless dithiocarbamates in lubricating oil compositions is their adverse effect on the fluoroelastomer seals compatibility properties of the compositions, such seals being commonly used in piston engines.

SUMMARY OF THE INVENTION

The present invention meets the above problem by providing ashless dithiocarbamates in which an amino group is substituted with at least one aryl group. Such dithiocarbamates, when used in lubricating oil compositions, are found to provide the composition with antiwear properties, without deleterious effect on fluoroelastomer seals compatibility.

According to a first aspect, the present invention provides an automotive lubricating oil composition for an internal combustion engine comprising, or made by admixing:

(A) an oil of lubricating viscosity in a major amount; and (B) oil-soluble additive components, in respective minor amounts, comprising (B1) a zinc dihydrocarbyl dithiophosphate additive; and (B2) an alkylenebis(dihydrocarbyldithiocarbamate) where at least one of the hydrocarbyl groups is a substituted or unsubstituted aryl group, present, for example at a composition treat rate of 0.05-5.00, preferably 0.2-1.50, mass % the composition having not greater than 1600, such as not greater than 1200, such as not greater than 800, such as not greater than 500, ppm by mass of phosphorus, expressed as phosphorus atoms.

By 'aryl' is meant a functional group derived from an aromatic ring compound where a hydrogen atom is removed from the ring.

According to a second aspect, the present invention provides a method of improving the antiwear properties of a lubricating oil composition without adversely affecting its fluoroelastomer compatibility properties comprising incorporating into the composition, in respective minor amounts, the additive components B1 and B2 as defined in the first aspect of the invention.

According to a third aspect, the present invention provides a method of lubricating surfaces of the combustion chamber of an internal combustion engine during its operation comprising:

(i) providing in respective minor amounts, the additive components B1 and B2 as defined in the first aspect of the invention in a major amount of an oil of lubricating viscosity to make a lubricating oil composition having antiwear properties without adverse fluoroelastomer compatibility properties;

(ii) providing the lubricating oil composition in the combustion chamber;

(iii) providing a hydrocarbon fuel in the combustion chamber; and (iv) combusting the fuel in the combustion chamber.

According to a fourth aspect, the present invention provides the use of the additive components B1 and B2 as defined in the first aspect of the invention to improve the antiwear properties of a lubricating oil composition without adversely affecting its fluoroelastomer compatibility properties.

The invention may also include the additive component B2 as defined in the first aspect of the invention.

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains only hydrogen and carbon atoms, or hetero atoms that do not affect the essentially hydrocarbyl nature of the group, and that is bonded to the remainder of the compound directly via a carbon atom.

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"major amount" means 50 mass % or more of a composition;

"minor amount" means less than 50 mass % of a composition;

"TBN" means total base number as measured by ASTM D2896;

"phosphorus content" is measured by ASTM D5185;

"sulfur content" is measured by ASTM D2622; and

"sulfated ash content" is measured by ASTM D874.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possibly other oils are blended, for example to produce a final lubricant (or lubricant composition).

A base oil is useful for making concentrates as well as for making lubricating oil compositions therefrom, and may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil and heavy duty diesel oil. Generally the viscosity of the oil ranges from 2 to 30, especially 5 to 20, $mm^2s^{-1}$ at 100° C.

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oil comprises the esters of dicarboxylic acids (e.g. phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except that they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Base oil may be categorised in Groups I to V according to the API EOLCS 1509 definition.

When the oil of lubricating viscosity is used to make a concentrate, it is present in a concentrate-forming amount (e.g., from 30 to 70, such as 40 to 60, mass %) to give a concentrate containing for example 1 to 90, such as 10 to 80, preferably 20 to 80, more preferably 20 to 70, mass % active ingredient of additives, being components B1 and B2 above, optionally with one or more co-additives. The oil of lubricating viscosity used in a concentrate is a suitable oleaginous, typically hydrocarbon, carrier fluid, e.g. mineral lubricating oil, or other suitable solvent. Oils of lubricating viscosity such as described herein, as well as aliphatic, naphthenic, and aromatic hydrocarbons, are examples of suitable carrier fluids for concentrates.

Concentrates constitute a convenient means of handling additives before their use, as well as facilitating solution or dispersion of additives in lubricating oil compositions. When preparing a lubricating oil composition that contains more than one type of additive (sometime referred to as "additive components"), each additive may be incorporated separately, each in the form of a concentrate. In many instances, however, it is convenient to provide a so-called additive "package" (also referred to as an "adpack") comprising one or more co-additives, such as described hereinafter, in a single concentrate.

The lubricating oil composition of the invention may be provided, if necessary, with one or more co-additives, such as described hereinafter. This preparation may be accomplished by adding the additive directly to the oil or by adding it in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

The lubricating oil compositions of the invention may be used to lubricate mechanical engine components, particularly in internal combustion engines, e.g. spark-ignited or compression-ignited two- or four-stroke reciprocating engines, by adding the composition thereto. Preferably, they are crankcase lubricants, amongst which may be mentioned heavy duty diesel (HDD) engine lubricants.

The lubricating oil compositions of the invention comprise defined components that may or may not remain the same chemically before and after mixing with an oleaginous carrier. This invention encompasses compositions which comprise the defined components before mixing, or after mixing, or both before and after mixing.

When concentrates are used to make the lubricating oil compositions, they may for example be diluted with 3 to 100, e.g. 5 to 40, parts by mass of oil of lubricating viscosity per part by mass of the concentrate.

The lubricating oil compositions of the present invention contain, as stated, levels of phosphorus, that are not greater than 1600, preferably not greater than 1200, more preferably not greater than 800, such as not greater than 500, for example, in the range of 200 to 800, or 200 to 500, ppm by mass of phosphorus, expressed as atoms of phosphorus, based on the total mass of the composition. Some of the above may be referred to as low phosphorus oils. In some cases, substantially no phosphorus is present. Preferably, the lubricating oil composition contains not greater than 1000, such as not greater than 800, ppm by mass of phosphorus, expressed as phosphorus atoms.

Typically, the lubricating oil composition may contain low levels of sulfur. Preferably, the lubricating oil composition contains up to 0.4, more preferably up to 0.3, most preferably up to 0.2, mass % sulfur, expressed as atoms of sulfur, based on the total mass of the composition.

Typically, the lubricating oil composition may contain low levels of sulfated ash. Preferably, the lubricating oil composition contains up to 1.0, preferably up to 0.8, mass % sulfated ash, based on the total mass of the composition.

Suitably, the lubricating oil composition may have a total base number (TBN) of between 4 to 15, preferably 5 to 11.

Additive Component Package (B)

(B1) Zinc Dihydrocarbyl Dithiophosphate Additive

These are frequently used as antiwear and antioxidant agents in lubricating oil such as in amounts of 0.1 to 10, preferably 0.2 to 2, mass %, based upon the total mass of the lubricating oil compositions. They may be prepared in accordance with known techniques by first forming a dihydrocarbyl dithiophosphoric acid (DDPA), usually by reaction of one or more alcohols or a phenol with $P_2S_5$, and then neutralising the formed DDPA with a zinc compound. For example, a dithiophosphoric acid may be made by reaction with mixtures of primary and secondary alcohols. Alternatively, multiple dithiophosphoric acids can be prepared where the hydrocarbyl groups on one acid are entirely secondary in character and the hydrocarbyl groups on the other acids are entirely primary in character. To make the zinc salt, any basic or neutral zinc compound could be used but the oxides, hydroxides and carbonates are most generally employed. Commercial additives frequently contain an excess of zinc due to use of an excess of the basic zinc compound in the neutralisation reaction. The art describes many examples of such additives.

Examples of suitable ZDDPs include those of the formula $$Zn[SP(S)(OR^3)(OR^4)]_2$$

where $R^3$ and $R^4$ are hydrocarbyl groups having 1-18 carbon atoms. See U.S. Pat. No. 6,642,188 for further details.

(B2) Alkylenebis(Dihydrocarbyldithiocarbamate)

These may be represented by the formula $$RR^1NC(S)—S—(CH_2)_n—S—C(S)—NRR^1$$

where R is a substituted or unsubstituted aryl group;

$R^1$ is hydrogen, branched or unbranched alkyl having from 3-18 carbon atoms, or substituted or unsubstituted aryl; and n is an integer from 1-20, preferably 1-6, more preferably 1. For example, the alkylene group may be methylene or ethylene.

Preferably, each aryl group is an unsubstituted phenyl group, or is an alkyl-substituted phenyl group, or is a hetero-substituted phenyl group, the alkyl group(s) having 1-30 carbon atoms.

As examples of (B2), there may be mentioned a compound where two hydrocarbyl groups are aryl and two hydrocarbyl groups are alkyl; and, referring to the above formula, a compound where each $R^1$ is an alkyl group.

As further examples of (B2), there may be mentioned a compound where each hydrocarbyl group is an aryl group; or, referring to the above formula, where each R and $R^1$ group is an aryl group.

The dithiocarbamates may be made by methods analogous to those known in the art such as exemplified in the specification. For example, an appropriately substituted amine may be reacted with sodium hydride, the resulting product reacted with carbon disulphide, and the resulting product then reacted with dihalomethane.

Co-Additives

Co-additives, with representative effective amounts, that may also be present, and are different from additive components B1 and B2, are listed below. All the values listed are stated as mass percent active ingredient.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier (1) | 0-6 | 0.01-4 |
| Mineral or Synthetic Base Oil | Balance | Balance |

(1) Viscosity modifiers are used only in multi-graded oils.

The final lubricating oil composition, typically made by blending the or each additive into the base oil, may contain from 5 to 25, preferably 5 to 18, typically 7 to 15, mass % of the co-additives, the remainder being oil of lubricating viscosity.

The above-mentioned co-additives are discussed in further detail as follows; as is known in the art, some additives can provide a multiplicity of effects; for example, a single additive may act as a dispersant and as an oxidation inhibitor.

A dispersant is an additive whose primary function is to hold solid and liquid contaminations in suspension, thereby passivating them and reducing engine deposits at the same time as reducing sludge depositions. For example, a dispersant maintains in suspension oil-insoluble substances that result from oxidation during use of the lubricant, thus preventing sludge flocculation and precipitation or deposition on metal parts of the engine.

Dispersants are usually "ashless", as mentioned above, being non-metallic organic materials that form substantially no ash on combustion, in contrast to metal-containing, and hence ash-forming materials. They comprise a long hydrocarbon chain with a polar head, the polarity being derived from inclusion of e.g. an O, P, or N atom. The hydrocarbon is an oleophilic group that confers oil-solubility, having, for example 40 to 500 carbon atoms. Thus, ashless dispersants may comprise an oil-soluble polymeric backbone.

A preferred class of olefin polymers is constituted by polybutenes, specifically polyisobutenes (PIB) or poly-n-butenes, such as may be prepared by polymerization of a $C_4$ refinery stream.

Dispersants include, for example, derivatives of long chain hydrocarbon-substituted carboxylic acids, examples being derivatives of high molecular weight hydrocarbyl-substituted succinic acid. A noteworthy group of dispersants is constituted by hydrocarbon-substituted succinimides, made, for example, by reacting the above acids (or derivatives) with a nitrogen-containing compound, advantageously a polyalkylene polyamine, such as a polyethylene polyamine. Particularly preferred are the reaction products of polyalkylene polyamines with alkenyl succinic anhydrides, such as described in U.S. Pat. Nos. 3,202,678; 3,154,560; 3,172,892; 3,024,195; 3,024,237, 3,219,666; and 3,216,936, that may be post-treated to improve their properties, such as borated (as described in U.S. Pat. Nos. 3,087,936 and 3,254,025), fluorinated and oxylated. For example, boration may be accomplished by treating an acyl nitrogen-containing dispersant with a boron compound selected from boron oxide, boron halides, boron acids and esters of boron acids.

A detergent is an additive that reduces formation of piston deposits, for example high-temperature varnish and lacquer deposits, in engines; it normally has acid-neutralising properties and is capable of keeping finely-divided solids in suspension. Most detergents are based on metal "soaps", that is metal salts of acidic organic compounds.

Detergents generally comprise a polar head with a long hydrophobic tail, the polar head comprising a metal salt of an acidic organic compound. The salts may contain a substantially stoichiometric amount of the metal when they are usually described as normal or neutral salts and would typically have a total base number or TBN (as may be measured by ASTM D2896) of from 0 to 80. Large amounts of a metal base can be included by reaction of an excess of a metal compound, such as an oxide or hydroxide, with an acidic gas such as carbon dioxide. The resulting overbased detergent comprises neutralised detergent as an outer layer of a metal base (e.g. carbonate) micelle. Such overbased detergents may have a TBN of 150 or greater, and typically of from 250 to 500 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g. sodium, potassium, lithium, calcium and magnesium. The most commonly-used metals are calcium and magnesium, which may both be present in detergents used in a lubricant, and mixtures of calcium and/or magnesium with sodium. Detergents may be used in various combinations.

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Suitable oil-soluble organo-molybdenum compounds have a molybdenum-sulfur core. As examples there may be mentioned dithiocarbamates, dithiophosphates, dithiophosphinates, xanthates, thioxanthates, sulfides, and mixtures thereof. Particularly preferred are molybdenum dithiocarbamates, dialkyldithiophosphates, alkyl xanthates and alkylthioxanthates. The molybdenum compound is dinuclear or trinuclear.

One class of preferred organo-molybdenum compounds useful in all aspects of the present invention is tri-nuclear molybdenum compounds of the formula $MO_3S_kL_nQ_z$ and mixtures thereof wherein L are independently selected ligands having organo groups with a sufficient number of carbon atoms to render the compounds soluble or dispersible in the oil, n is from 1 to 4, k varies from 4 through to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The molybdenum compounds may be present in a lubricating oil composition at a concentration in the range 0.1 to 2 mass %, or providing at least 10 such as 50 to 2,000 ppm by mass of molybdenum atoms.

Preferably, the molybdenum from the molybdenum compound is present in an amount of from 10 to 1500, such as 20 to 1000, more preferably 30 to 750, ppm based on the total weight of the lubricating oil composition. For some applications, the molybdenum is present in an amount of greater than 500 ppm.

Anti-oxidants are sometimes referred to as oxidation inhibitors; they increase the resistance of the composition to oxidation and may work by combining with and modifying peroxides to render them harmless, by decomposing peroxides, or by rendering an oxidation catalyst inert. Oxidative deterioration can be evidenced by sludge in the lubricant, varnish-like deposits on the metal surfaces, and by viscosity growth.

They may be classified as radical scavengers (e.g. sterically hindered phenols, secondary aromatic amines, and organo-copper salts); hydroperoxide decomposers (e.g., organosulfur and organophosphorus additives); and multifunctionals (e.g. zinc dihydrocarbyl dithiophosphates, which may also function as anti-wear additives, and organo-molybdenum compounds, which may also function as friction modifiers and anti-wear additives).

Examples of suitable antioxidants are selected from copper-containing antioxidants, sulfur-containing antioxidants, aromatic amine-containing antioxidants, hindered phenolic antioxidants, dithiophosphates derivatives, metal thiocarbamates, and molybdenum-containing compounds.

Anti-wear agents reduce friction and excessive wear and are usually based on compounds containing sulfur or phosphorous or both, for example that are capable of depositing polysulfide films on the surfaces involved.

Rust and corrosion inhibitors serve to protect surfaces against rust and/or corrosion. As rust inhibitors there may be mentioned non-ionic polyoxyalkylene polyols and esters thereof, polyoxyalkylene phenols, and anionic alkyl sulfonic acids.

Pour point depressants, otherwise known as lube oil flow improvers, lower the minimum temperature at which the oil will flow or can be poured. Such additives are well known. Typical of these additive are $C_8$ to $C_{18}$ dialkyl fumarate/vinyl acetate copolymers and polyalkylmethacrylates.

Additives of the polysiloxane type, for example silicone oil or polydimethyl siloxane, can provide foam control.

A small amount of a demulsifying component may be used. A preferred demulsifying component is described in EP-A-330,522. It is obtained by reacting an alkylene oxide with an adduct obtained by reaction of a bis-epoxide with a polyhydric alcohol. The demulsifier should be used at a level not exceeding 0.1 mass % active ingredient. A treat rate of 0.001 to 0.05 mass % active ingredient is convenient.

Viscosity modifiers (or viscosity index improvers) impart high and low temperature operability to a lubricating oil. Viscosity modifiers that also function as dispersants are also known and may be prepared as described above for ashless dispersants. In general, these dispersant viscosity modifiers are functionalised polymers (e.g. interpolymers of ethylene-propylene post grafted with an active monomer such as maleic anhydride) which are then derivatised with, for example, an alcohol or amine.

The lubricant may be formulated with or without a conventional viscosity modifier and with or without a dispersant viscosity modifier. Suitable compounds for use as viscosity modifiers are generally high molecular weight hydrocarbon polymers, including polyesters. Oil-soluble viscosity modifying polymers generally have weight average molecular weights of from 10,000 to 1,000,000, preferably 20,000 to 500,000, which may be determined by gel permeation chromatography or by light scattering.

EXAMPLES

The invention will now be particularly described in the following examples which are not intended to limit the scope of the claims hereof.

Components

Methylenebis(N-n-octyl-N-phenyldithiocarbamate): OCTYLPHENYL DTC

This was synthesized as follows.

N-n-octylaniline (1 eq., 1 wt) was added to a solution of 60% sodium hydride in mineral oil (1 eq, 0.19 wt), in anhydrous toluene (16 vols). This reaction mixture was heated under reflux (111° C.) for 18 hours, cooled to 5° C., and a solution of carbon disulfide (1 eq, 0.45 wt) in anhydrous tetrahydrofuran ("THF"; 5.42 vols) added. The resulting mixture was warmed to ambient temperature and a solution of diiodomethane (0.5 eq, 0.38 wt) in anhydrous THF (3.3 vols) added. The mixture was stirred at ambient temperature and, upon completion of the reaction, the volume of the mixture was halved by distillation. Any solid was filtered off and the filtrate concentrated to dryness to yield the desired component product.

Methylenebis(N,N$^1$-di($C_9$alkylsubstituted)phenyldithiocarbamate: TETRAPHENYL DTC This was made, by an analogous method, from a $C_9$ branched alkyl-substituted diphenylamine material, 7:3 mono:di substituted in its aromatic rings.

Methylenebis(dibutyldithiocarbamate): VANLUBE 7723

This was a commercially-available compound marketed as VANLUBE (Registered Trade Mark) 7723 additive by R.T. Vanderbilt Company, Inc.

Zinc dihydrocarbyldithiophosphate ("ZDDP")

This was a commercially-available mixed secondary/primary alkyl ZDDP.

Lubricating Oil Compositions

A base oil formulation ("Oil A") was prepared from basestocks, detergents, dispersant, antioxidants, polyisobutene and viscosity modifier. Certain of the above components were blended with Oil A to give rise to a set of lubricating oil compositions designed to be an ACEA E6 HDD (heavy duty oil) composition. The compositions did not contain any antiwear additives other than the above-listed components. The concentrations of these components are indicated in the tables under the TESTING & RESULTS sub-heading.

Testing & Results

Wear Testing—Fresh Oil

Samples of the above compositions were tested using a PCS Instruments high frequency reciprocating rig (HFRR) on a standard protocol comprising the following conditions:

- 120 minutes
- 20 Hz reciprocation of 1 mm stroke length
- 200 g load using standard equipment manufacturer-supplied steel substrates.

The wear scar measurements reported were taken of the wear scars on the HFRR discs. The instrument used for these measurements was a Zemetrics ZeScope 3D optical profilometer. The measurements reported are the void volumes of the wear scars on the HFRR discs. Each test was repeated two further times and the recorded wear measurement was the average of these values.

The HFRR data for compositions 1-4 are summarized in the table below. Each composition contained 800 ppm P (from the ZDDP), and the results are disk wear scar volume.

| | Components | | | | |
|---|---|---|---|---|---|
| Composition | ZDDP | TETRA-PHENYL DTC | OCTYL-PHENYL DTC | VANLUBE 7723 | HFRR ($\mu m^3$) |
| 1 (control) | 1 wt % | — | — | — | 194,168.1 |
| 2 | 1 wt % | 1230 ppmS | | | 80,588.5 |
| 3 | 1 wt % | — | 1230 ppmS | — | 47,048.0 |
| 4 (comparative) | 1 wt % | — | — | 1230 ppmS | 73,500.0 |

As can be seen from the table, each of the compositions that contained a methylene-bridged dithiocarbamate of the invention in combination with a ZDDP (Compositions 2 to 3) gave an improvement in antiwear performance over Composition 1 (control) and comparable with or better than Composition 4

(comparative). The best result was seen when using the OCTYLPHENYL DTC at 1230 ppm sulfur treat rate (Composition 3).

Aged Oil Testing

To achieve differentiation between Composition 1 and analogous Composition 5 (containing 400 ppm P), the compositions were aged in a DKA oxidation rig. The conditions for this test were:

160° C. for 192 hours

Air blown through sample at a rate of 10 L/hour

Compositions 6 and 7 (of the invention and that contained 400 ppm P) were also aged via this test to act as a comparison with Composition 5.

Samples were tested using a PCS Instruments HFRR on a standard protocol comprising the following conditions:

30 minutes at 100° C. (fresh oil) then 90 minutes at 100° C. (DKA aged oils of Compositions 2, 8 and 9)

20 Hz reciprocation of 1 min stroke length 200 g load using standard equipment manufacturer-supplied steel substrates.

The wear scar measurements reported were taken of the wear scars on the HFRR discs. The instrument used for these measurements was a Zemetrics ZeScope 3D optical profilometer. The measurements reported are the void volumes of the wear scars on the HFRR discs. Each test was repeated two further times and the recorded wear measurement was the average of these values.

The HFRR data for aged Compositions 1, 5, 6 and 7 are summarised in the table below.

| | Components | | | |
|---|---|---|---|---|
| Composition | ZDDP | TETRA-PHENYL DTC | OCTYLPHENYL DTC | HFRR ($\mu m^3$) |
| 1 (control) | 1 wt % | — | — | 147,439.235 |
| 5 (control) | 0.5 wt % | — | — | 438,457.715 |
| 6 | 0.5 wt % | 1230 ppmS | — | 196,822.500 |
| 7 | 0.5 wt % | — | 1230 ppmS | 56,690.000 |

As can be seen from the table, use of the DTC components in oil containing 400 ppm P (Composition 6 and 7) gave a significant antiwear credit over the formulation containing the same amount of P (Composition 5) and also (for Composition 6) over the formulation containing twice the amount of P (Composition 1), thus showing that antiwear improvement can also be maintained in aged oils.

Fluoroelastomer Seals Tests

Compositions 1 (control), 2 and 3 (invention), and 4 (comparison) were subjected to fluoroelastomer seals testing. The test was the CEC L-39-T-96 ACEA SEALS RE1 fluoroelastomer seal test. This measures the tensile strength variation, elongation rupture variation, hardness DIDC variation, and volume variation.

The results are given in the table below.

| Elastomer | Test | ACEA Limit 2004 | Composition 1 (control) | Composition 2 | Composition 3 | Composition 4 (comparison) |
|---|---|---|---|---|---|---|
| Fluroelastomer | Tensile Strength variation (%) | −40/+10 | −24 | 1 | −9 | −44 |
| | Elongation Rupture Variation (%) | −50/+10 | −41 | −21 | −26 | −56 |
| | Hardness DIDC Variation (points) | −1/+5 | 0 | 0 | 1 | 2 |
| | Volume Variation (%) | −1/+5 | 0 | 2.4 | 0.3 | 0.5 |

As can be seen, each of the Compositions of the invention (2 and 3) gave results within the limits for the fluoroelastomer seals tests, as did the control (Composition 1). The comparative Composition (4) however gave results for tensile strength variation, and elongation rupture variation that are outside the limits for the test. This shows that the DTC's of the invention can be differentiated from the commercially-available DTC antiwear component on the basis of fluoroelastomer seals compatibility. Also, Compositions 2 and 3 gave better results in respect of tensile strength variation and elongation rupture variation the Composition 1 (control).

What is claimed is:

1. An automotive lubricating oil composition for an internal combustion engine comprising, or made by admixing:

(A) an oil of lubricating viscosity in a major amount; and (B) oil-soluble additive components, in respective minor amounts comprising (B1) a zinc dihydrocarbyl dithiophosphate additive; and (B2) an alkylenebis(dihydrocarbyldithiocarbamate) where at least one of the hydrocarbyl groups is a substituted or unsubstituted aryl group, the composition having not greater than 1600 ppm by mass of phosphorus, expressed as phosphorus atoms.

2. The composition of claim 1 where B2 is represented by the formula $$RR^1NC(S)—S—(CH_2)_n—S—C(S)—NRR^1$$

where

R is a substituted or unsubstituted aryl group;

$R^1$ is hydrogen, branched or unbranched alkyl having from 1-30 carbon atoms, or substituted or unsubstituted aryl; and n is an integer from 1-20.

3. The composition of claim 1 wherein each aryl group is an unsubstituted phenyl group or is an alkyl-substituted phenyl group or is a heteroatom-substituted phenyl group, the alkyl group(s) being branched or unbranched and having 1-30 carbon atoms.

4. The composition of claim 1 where, in (B2), two of the hydrocarbyl groups are each substituted or unsubstituted aryl groups and two of the hydrocarbyl groups are each alkyl groups.

5. The composition of claim 2 wherein each aryl group is an unsubstituted phenyl group or is an alkyl-substituted phenyl group or is a heteroatom-substituted phenyl group, the alkyl group(s) being branched or unbranched and having 1-30 carbon atoms.

6. The composition of claim 2 where each $R^1$ is an alkyl group.

7. The composition of claim 3 where each $R^1$ is an alkyl group.

8. The composition of claim 1 where, in (B2), each hydrocarbyl group, is a substituted or unsubstituted aryl group.

9. The composition of claim 2 where each $R^1$ is a substituted or unsubstituted aryl group.

10. The composition of claim 3 where each $R^1$ is a substituted or unsubstituted aryl group.

11. The composition of claim 1 where, in B2, the alkylene group is a methylene group.

12. A composition of claim 1 wherein the composition has a sulfated ash value of up to 1.0 and a sulfur content of up to 0.4 mass %.

13. A composition of claim 1 wherein the composition contains other additive components, different from (B1) and (B2), selected from one or more ashless dispersants, metal detergents, corrosion inhibitors, antioxidants, pour point depressants, other antiwear agents, friction modifiers, demulsifiers, anti-foam agents and friction modifiers.

14. A method of improving the antiwear properties of a lubricating oil composition without adversely affecting its fluoroelastomer compatibility properties comprising incorporating into the composition, in respective minor amounts, the additive components B1 and B2 as defined in claim 1.

15. A method of lubricating surfaces of the combustion chamber of an internal combustion engine during its operation comprising:

(i) providing, in respective minor amounts, the additive components B1 and B2 as defined in claim 1 in a major amount of an oil of lubricating viscosity to make a lubricating oil composition having antiwear properties without adverse fluoroelastomer compatibility properties;

(ii) providing the lubricating oil composition in the combustion chamber;

(iii) providing a hydrocarbon fuel in the combustion chamber; and (iv) combusting the fuel in the combustion chamber.

* * * * *